US008884595B2

(12) United States Patent
Imura

(10) Patent No.: US 8,884,595 B2
(45) Date of Patent: Nov. 11, 2014

(54) PHASE COMPENSATION CIRCUIT, SEMICONDUCTOR INTEGRATED CIRCUIT HAVING PHASE COMPENSATION CIRCUIT, AND POWER SUPPLY CIRCUIT HAVING PHASE COMPENSATION CIRCUIT

(71) Applicant: Denso Corporation, Kariya (JP)

(72) Inventor: Takashi Imura, Anjo (JP)

(73) Assignee: DENSO CORPORATION, Kariya (JP)

( * ) Notice: Subject to any disclaimer, the term of this patent is extended or adjusted under 35 U.S.C. 154(b) by 103 days.

(21) Appl. No.: 13/684,720

(22) Filed: Nov. 26, 2012

(65) Prior Publication Data

US 2013/0134952 A1 May 30, 2013

(30) Foreign Application Priority Data

Nov. 28, 2011 (JP) ..... 2011-258877

(51) Int. Cl.
*G05F 1/40* (2006.01)
*G05F 1/575* (2006.01)

(52) U.S. Cl.
CPC ..... *G05F 1/575* (2013.01)
USPC ..... 323/280

(58) Field of Classification Search
USPC ..... 323/269, 271, 273, 282–285, 351
See application file for complete search history.

(56) References Cited

U.S. PATENT DOCUMENTS

| | | | | |
|---|---|---|---|---|
| 4,859,911 | A * | 8/1989 | Kinnard et al. | 315/169.3 |
| 5,117,204 | A * | 5/1992 | Endo et al. | 331/8 |
| 5,990,671 | A | 11/1999 | Nagata | |
| 6,369,558 | B2 * | 4/2002 | Umemoto | 323/282 |
| 6,448,752 | B1 * | 9/2002 | Umemoto | 323/288 |
| 6,979,985 | B2 * | 12/2005 | Yoshida et al. | 323/282 |
| 7,560,911 | B2 * | 7/2009 | Nishida | 323/259 |
| 2007/0174017 | A1 | 7/2007 | Ichiba et al. | |
| 2012/0008346 | A1 * | 1/2012 | Kawamura | 363/21.15 |
| 2013/0043851 | A1 * | 2/2013 | Ishino | 323/282 |

FOREIGN PATENT DOCUMENTS

| | | | |
|---|---|---|---|
| JP | 03-143293 | A | 6/1991 |
| JP | 05-327365 | A | 12/1993 |
| JP | 2002-032113 | A | 1/2002 |
| JP | 2003-058260 | A | 2/2003 |
| JP | 2009-294841 | A | 12/2009 |

* cited by examiner

*Primary Examiner* — Adolf Berhane
(74) *Attorney, Agent, or Firm* — Posz Law Group, PLC

(57) ABSTRACT

In a power supply circuit, an error amplifier controls a main transistor based on a detection voltage according to an output voltage and a reference voltage corresponding to a target voltage of the output voltage such that the output voltage coincides with the target value. A phase compensation circuit for the power supply circuit includes a level shift circuit and a phase compensation capacitor. The level shift circuit generates a shift voltage by shifting a dc component of the output voltage toward a ground potential by a predetermined voltage, and outputs the shift voltage from an output terminal of the level shift circuit. The phase compensation capacitor is disposed on a route between the output terminal of the level shift circuit and an input terminal of an amplifier circuit of the error amplifier.

7 Claims, 11 Drawing Sheets

PHASE COMPENSATION CIRCUIT, SEMICONDUCTOR INTEGRATED CIRCUIT HAVING PHASE COMPENSATION CIRCUIT, AND POWER SUPPLY CIRCUIT HAVING PHASE COMPENSATION CIRCUIT

CROSS REFERENCE TO RELATED APPLICATION

This application is based on Japanese Patent Application No. 2011-258877 filed on Nov. 28, 2011, the disclosure of which is incorporated herein by reference.

TECHNICAL FIELD

The present disclosure relates to a phase compensation circuit for a power supply circuit that generates a constant output voltage from an input voltage, and a semiconductor integrated circuit having the phase compensation circuit.

BACKGROUND

In regard to a stabilized power supply circuit, such as a linear regulator and a switching regulator, that regulates an output voltage to a constant target value, it has been widely known to employ a phase compensation circuit to ensure stabilization of the power supply circuit. For example, such a technique is described in JP2003-058260A and JP2006-109421A, which corresponds to US 2007/0174017 A1. The phase compensation circuit is disposed between an internal node of an error amplifier that controls the output voltage and an output node that outputs the output voltage.

The phase compensation circuit described above requires a capacitive element (capacitor) having a withstand voltage corresponding to the output voltage. Therefore, it is necessary to increase the withstand voltage of the capacitive element with an increase in the target value of the output voltage.

In a general monolithic process, it is necessary to increase the thickness of an oxidized film between electrodes of the capacitive element so as to increase the withstand voltage. However, a capacitance value per unit area reduces with the increase in thickness of the oxidized film. Therefore, when the phase compensation circuit is integrated into a semiconductor integrated circuit (IC), a circuit area increases with the increase in the withstand voltage of the capacitive element. Also in a case where the capacitive element is provided by a discrete component, the size of the component increases with the increase in the withstand voltage. Therefore, a similar drawback arises.

To address the drawbacks described above, for example, JP2003-058260A and JP2006-109421A describe a technique to double an apparent capacitance value of the capacitive element of the phase compensation circuit by using an active element. However, such a technique requires an amplifier circuit having a frequency band equal to or greater than a frequency that appears as a capacity. Therefore, a circuit structure is complex, and consumption current increases.

SUMMARY

It is an object of the present disclosure to provide a phase compensation circuit, which is capable of performing a phase compensation of a power supply circuit without increasing a circuit area and a consumption current even when a target value of an output voltage of the power supply circuit is relatively high, and to provide a semiconductor integrated circuit having the phase compensation circuit.

A power supply circuit generates a constant output voltage from an input voltage inputted thereto through a power supply input terminal, and outputs the output voltage from a power supply output terminal. The power supply circuit includes a main transistor that controls power supply from the power supply input terminal to the power supply output terminal, and an error amplifier that controls an operation of the main transistor based on a detection voltage according to the output voltage and a reference voltage according to a target value of the output voltage such that the output voltage coincides with the target value.

According to an aspect of the present disclosure, a phase compensation circuit for the power supply circuit includes a level shift circuit and a phase compensation capacitor. The level shift circuit receives the output voltage and shifts a dc component of the output voltage toward a ground potential by a predetermined voltage to generate a shift voltage. The phase compensation capacitor is disposed on a route between an output terminal of the level shift circuit and an input terminal of an amplifier circuit of the error amplifier.

In the phase compensation circuit having the structure described above, the shift voltage is generated by shifting the do component of the output voltage. Therefore, the shift voltage has an ac component equivalent to the output voltage. The shift voltage outputted from the level shift circuit is applied to the input terminal of the amplifier circuit of the error amplifier through the compensation capacitor. That is, the ac component of the output voltage is fed back to the input terminal of the amplification circuit through the phase compensation capacitor. In this way, the phase compensation circuit having the structure described above performs a phase compensation of the power supply circuit, and stability of the power supply circuit improves.

Terminals of the phase compensation capacitor are applied with the shift voltage and the voltage of the input terminal of the amplifier circuit. Namely, the voltage applied between the terminals of the phase compensation capacitor is lower than a voltage applied between terminals of a capacitor of a conventional phase compensation circuit by the predetermined voltage shifted by the level shift circuit. Therefore, the phase compensation is achieved by using the phase compensation capacitor having a withstand voltage lower than the target value of the output voltage. Accordingly, the phase compensation circuit enables the phase compensation of the power supply circuit without largely increasing the circuit area and the consumption current, even if the target value of the output voltage of the power supply circuit is relatively high.

For example, the phase compensation circuit is integrated into a semiconductor integrated circuit. In such a case, the phase compensation capacitor is provided by one of a capacitor defined between a wiring pattern and a semiconductor substrate and a capacitor defined between wiring patterns, and an electrode of the phase compensation capacitor adjacent to the wiring pattern is coupled to the input terminal of the amplifier circuit.

BRIEF DESCRIPTION OF THE DRAWINGS

The above and other objects, features and advantages of the present disclosure will become more apparent from the following detailed description made with reference to the accompanying drawings, in which like parts are designated by like reference numbers and in which.

DETAILED DESCRIPTION

First Embodiment

Figure 1:
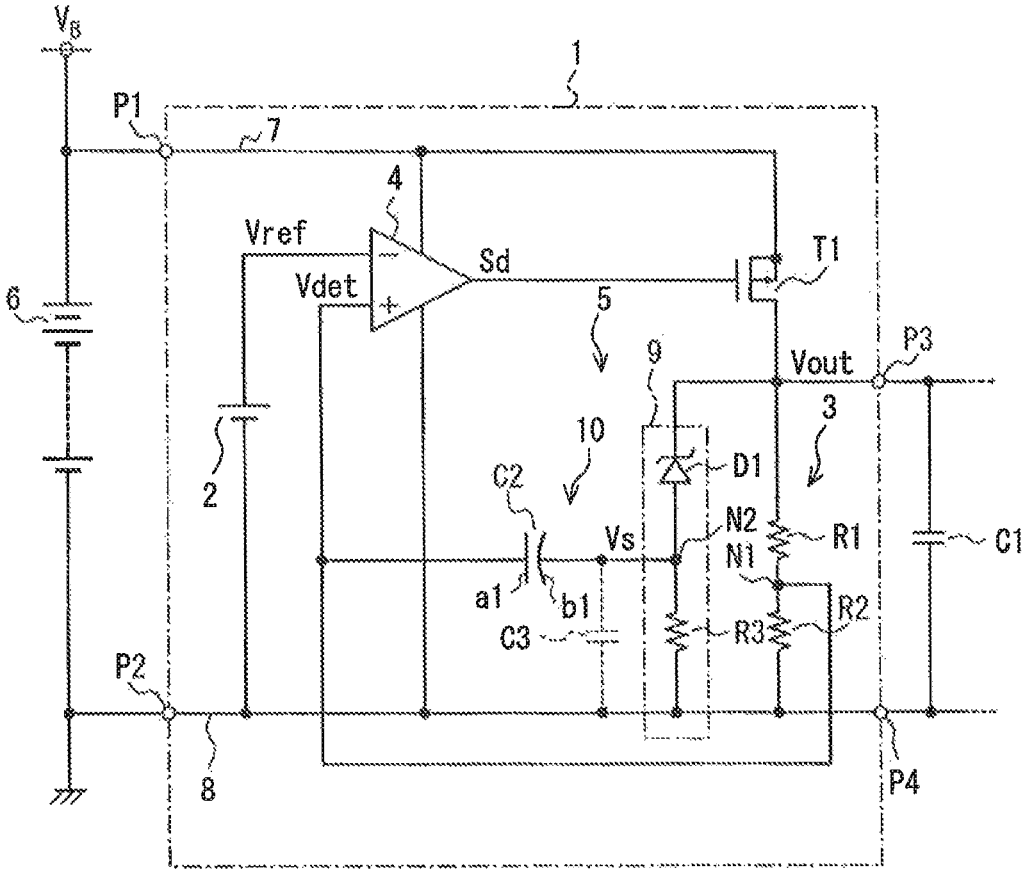
FIG. 1 is a schematic circuit diagram of a series regulator power supply circuit with a phase compensation circuit according to a first embodiment of the present disclosure.

A first embodiment of the present disclosure will be hereinafter described with reference to FIGS. 1, 2A and 2B. FIG. 1 is a schematic circuit diagram of a power supply circuit 1 that performs feedback control to regulate an output voltage to a constant target value. For example, the power supply circuit 1 is a series regulator power supply circuit.

The power supply circuit 1 includes a main transistor T1, a reference voltage generation circuit 2, a voltage detection circuit 3, an error amplifier 4, and a phase compensation circuit 5. For example, the power supply circuit 1 may be configured as a semiconductor integrated circuit (IC). That is, component elements of the power supply circuit 1 may be integrated into the semiconductor integrated circuit. As another example, the component elements of the power supply circuit 1 other than the main transistor T1 may be integrated into a semiconductor integrated circuit.

The power supply circuit 1 is supplied with a power source voltage VB from an external dc power source 6 through a power supply input terminal P1 and a ground terminal P2. The power source voltage VB corresponds to an input voltage. For example, the steady-state value of the power source voltage VB is approximately +12 V. The power supply input terminal P1 is coupled to a power supply line 7 within the power supply circuit 1, and the ground terminal P2 is coupled to a ground line 8 within the power supply circuit 1.

The main transistor T1 is a P-channel power MOSFET A source of the main transistor T1 is coupled to the power supply line 7, and a drain of the main transistor T1 is coupled to a power supply output terminal P3. That is, the main transistor T1 is disposed on a power supply route between the power supply input terminal P1 and the power supply output terminal P3.

The power supply circuit 1 reduces the power source voltage VB to a predetermined output voltage Vout by means of the main transistor T1, and outputs the output voltage Vout to a load circuit, as a target of power supply, through the power supply output terminal P3 and a ground terminal P4. The ground terminal P4 is coupled to the ground line 8 within the power supply circuit.

A capacitor C1 is coupled between the power supply terminal P3 and the ground terminal P4. The capacitor C1 is a smoothing capacitor for reducing fluctuation of the output voltage Vout. The capacitor C1 is disposed outside of the power supply circuit 1.

The reference voltage generation circuit 2 is, for example, a bandgap reference voltage circuit. The reference voltage generation circuit 2 generates a reference voltage Vref (e.g., +1.2 V) for instructing a target value (e.g., +5 V) of the output voltage Vout. The reference voltage Vref generated from the reference voltage generation circuit 2 is applied to an inverting input terminal of the error amplifier 4.

The voltage detection circuit 3 includes a series circuit of a resistor R1 and a resistor R2. The series circuit is coupled between the drain of the main transistor T1 and the ground line 8. A voltage at a connecting point between the resistor R1 and the resistor R2 is defined as a detection voltage Vdet. The detection voltage Vdet is provided by dividing the output voltage Vout with the resistor R1 and the resistor R2. The detection voltage Vdet is applied to a non-inverting input terminal of the error amplifier 4. A resistance value of each of the resistor R1 and the resistor R2 is determined such that the detection voltage Vdet coincides with the reference voltage Vref when the output voltage Vout has the target value.

The error amplifier 4 operates as being supplied with the power source voltage VB through the power supply line 7 and the ground line 8. The error amplifier 4 generates an error amplifier signal Sd according to a difference between the detection voltage Vdet and the reference voltage Vref. The error amplifier signal Sd is provided to a gate of the main transistor T1. Therefore, the operation of the main transistor T1 is controlled according to the error amplifier signal Sd. Namely, the error amplifier 4 performs feedback control of the main transistor T1 based on the detection voltage Vdet and the reference voltage Vref such that the output voltage Vout coincides with the target value.

The phase compensation circuit 5 compensates a frequency property such that the power supply circuit 1 performs a negative feedback operation in an entire operation region. Namely, the phase compensation circuit 5 performs a phase compensation.

The phase compensation circuit 5 includes a level shift circuit 9 and a phase compensation section 10. The level shift circuit 9 includes a Zener diode D1 and the resistor R3. The level shift circuit 9 receives the output voltage Vout, and shifts a dc component of the output voltage Vout toward a ground potential by a predetermined voltage, that is, to a predetermined level. The ground potential corresponds to a potential of the ground line 8, and is equal to 0 V.

The Zener diode D1 has a Zener voltage corresponding to the predetermined voltage. A cathode of the Zener diode D1 is coupled to the power supply output terminal P3. An anode of the Zener diode D1 is coupled to the ground line through the resistor R3. That is, the Zener diode D1 is disposed between the power supply output terminal P3 and the ground line 8 in a reverse direction. The resistor R3 restricts an electric current flowing in the Zener diode D1. A resistance value of the resistor R3 is determined such that an electric current necessary to carry out a breakdown operation can be applied to the Zener diode C1. In this configuration, a shift voltage Vs is outputted from a node N2 (i.e., the anode of the Zener diode D1), which is defined at a connecting point between the Zener diode D1 and the resistor R3.

The phase compensation section 10 includes a capacitor C2 as a phase compensation capacitor. A first terminal (first electrode) a1 of the phase compensation capacitor C2 is coupled to the non-inverting input terminal of the error amplifier 4. A second terminal (second electrode) b1 of the phase compensation capacitor C2 is coupled to the node N2. In other words, the phase compensation capacitor C2 is disposed between the node N2 and an input terminal of an amplifier circuit (differential amplifier circuit), which is one of amplifier circuits (no shown) constituting the error amplifier 4 and is disposed at an input stage of the error amplifier 4. A parasitic capacitance C3 exists between the second terminal b1 of the phase compensation capacitor C2 and the ground line 8. Since the power supply circuit 1 includes the phase compensation circuit 5 described above, oscillation is restricted, and the feedback control is stabilized.

Figure 2A:
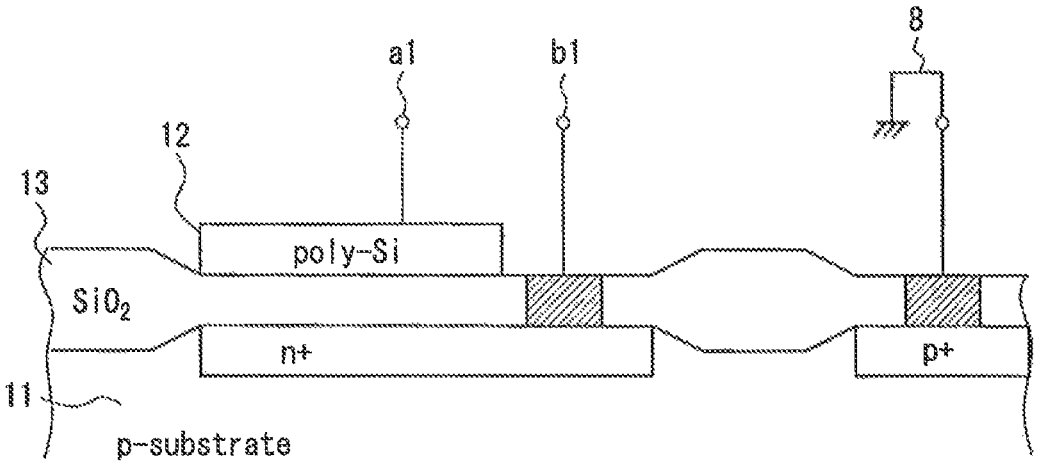
FIG. 2A is a schematic diagram of an example of a phase compensation capacitor of the phase compensation circuit, when the power supply circuit is configured as an integrated circuit, according to the first embodiment.
Figure 2B:
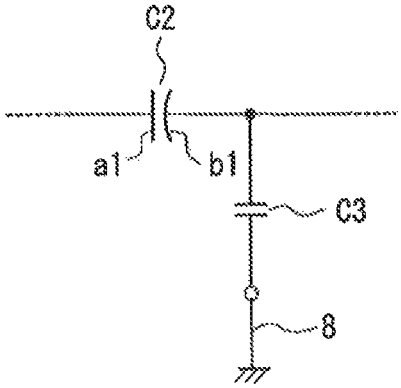
FIG. 2B is a schematic circuit diagram of the phase compensation capacitor shown in FIG. 2A.

FIG. 2A is a diagram illustrating a schematic sectional view of an example of the phase compensation capacitor C2 formed in the semiconductor integrated circuit. FIG. 2B is a diagram illustrating an equivalent circuit of the phase compensation capacitor C2.

As shown in FIG. 2A, the phase compensation capacitor C2 is formed between a semiconductor substrate (p-substrate) 11 and a wiring pattern (poly-Si) 12. An oxidized film 13 (e.g., $SiO_2$) is disposed between the semiconductor substrate 11 and the wiring pattern 12 (i.e., between the electrodes). The wiring pattern 12 is coupled to the first terminal a1 of the phase compensation capacitor C2. The semiconductor substrate 11 is coupled to the second terminal b1 of the phase compensation capacitor. C2. As shown in FIGS. 2A and 2B, the parasitic capacitance C3 caused by a p-n junction (reverse bias) exists between the second terminal b1 and the ground line 8 to which the ground potential is applied.

Next, an operation and advantageous effects of the power supply circuit 1 will be described.

In the power supply circuit 1, the error amplifier 4 controls the operation of the main transistor T1 based on the detection voltage Vdet and the reference voltage Vref. For example, during a period where the detection voltage Vdet is higher than the reference voltage Vref, that is, during a period where the output voltage Vout is higher than the target value, the error amplifier 4 outputs the error amplification signal Sd at a high level (e.g., a potential of the power supply line 7, +12 V). As a result, the main transistor T1 is turned off, and the output voltage Vout reduces.

During a period where the detection voltage Vdet is lower than the reference voltage Vref, that is, during a period where the output voltage Vout is lower than the target value, the error amplifier 4 outputs the error amplification signal Sd at a low level (e.g., a potential of the ground line 8, 0 V). As a result, the main transistor T1 is turned on, and the output voltage Vout increases. In this way, the error amplifier 4 controls the main transistor T1 to regulate the output voltage Vout to the target value of +5 V.

While constant voltage control described above is performed, the phase compensation of the power supply circuit 1 is performed by the phase compensation circuit 5. In regard to the phase compensation, the shift voltage Vs outputted from the level shift circuit 9 is applied to the non-inverting input terminal of the error amplifier 4 through the phase compensation capacitor C2. The shift voltage Vs is produced by shifting the do component of the output voltage Vout to the predetermined level. Thus, an ac component of the shift voltage Vs is equivalent to an ac component of the output voltage Vout. That is, the ac component of the output voltage Vout is fed back to the non-inverting input terminal of the error amplifier 4 through the phase compensation capacitor C2. In this way, the phase compensation circuit 5 performs the phase compensation of the power supply circuit 1 to improve stability of the power supply circuit 1.

Between the terminals a1, b1 of the phase compensation capacitor C2 is a voltage corresponding to a difference between the shift voltage Vs and the voltage at the non-inverting input terminal of the error amplifier 4 applied. That is, the voltage applied between the terminals a1, b1 of the phase compensation capacitor C2 is lower than a voltage applied between terminals of a capacitor of a conventional phase compensation circuit by the predetermined voltage shifted by the level shift circuit 9. Therefore, as the phase compensation capacitor C2 of the present embodiment, a capacitor having a withstand voltage lower than the target value of the output voltage Vout can be used.

Since the phase compensation circuit 5 includes the level shift circuit 9, a consumption current of the power supply circuit 1 increases for the amount corresponding to the current supplied to the Zener diode D1. However, the increase in the consumption current is relatively small. Therefore, even if the phase compensation circuit 5 including the level shift circuit 9 is employed in a high voltage power supply circuit in which the output voltage Vout has a relatively high target value, the phase compensation circuit 5 enables the phase compensation of the power supply circuit without largely increasing the circuit area and the consumption current.

Since the level shift circuit 9 is constructed of the Zener diode D1 and the resistor R3, the structure of the phase compensation circuit 5 is simplified. The predetermined voltage (predetermined level) shifted by the level shift circuit 9 is substantially equal to the Zener voltage of the Zener diode D1. Therefore, the predetermined voltage shifted by the level shift circuit 9 can be easily set by the Zener voltage of the Zener diode D1 used.

In a case where the phase compensation circuit 5 is integrated into the semiconductor integrated circuit, the second terminal b1 of the phase compensation capacitor C2 accompanied with the parasitic capacitance C3 is coupled to a node with a high impedance, the node will be considered as the ground potential due to a low frequency. As a result, the effect of the phase compensation will reduce. Therefore, in the case where the phase compensation circuit 5 is integrated into the semiconductor integrated circuit, the second terminal b1 of the phase compensation capacitor C2 accompanied with the parasitic capacitance C3 is preferably coupled to the node with a low impedance.

In the present embodiment, therefore, the first terminal a1 is coupled to the non-inverting input terminal of the error amplifier 4 and the second terminal b1 of the phase compensation capacitor C2 is coupled to the node N2. The impedance of the power supply output terminal P3 is very low because of the effect of the capacitor C1 disposed outside of the power supply circuit 1. Also, it is considered that the ac component is short-circuited between the power supply output circuit P3 and the node N2. Therefore, it is considered that the impedance of the node N2 to which the second terminal b1 of the phase compensation capacitor C2 is coupled is very low. Accordingly, in the structure of the present embodiment, the effect of the parasitic capacitance C3 relative to the effect of the phase compensation by the phase compensation capacitor C2 can be reduced.

Second Embodiment

A second embodiment of the present disclosure will be described with reference to FIG. 3. In a power supply circuit 21 of the second embodiment, a coupling position of the phase compensation capacitor C2 is different from that of the first embodiment. Hereinafter, like parts are designated with like reference numbers, and a description thereof will not be repeated. A point different from the first embodiment will be mainly described.

Figure 3:
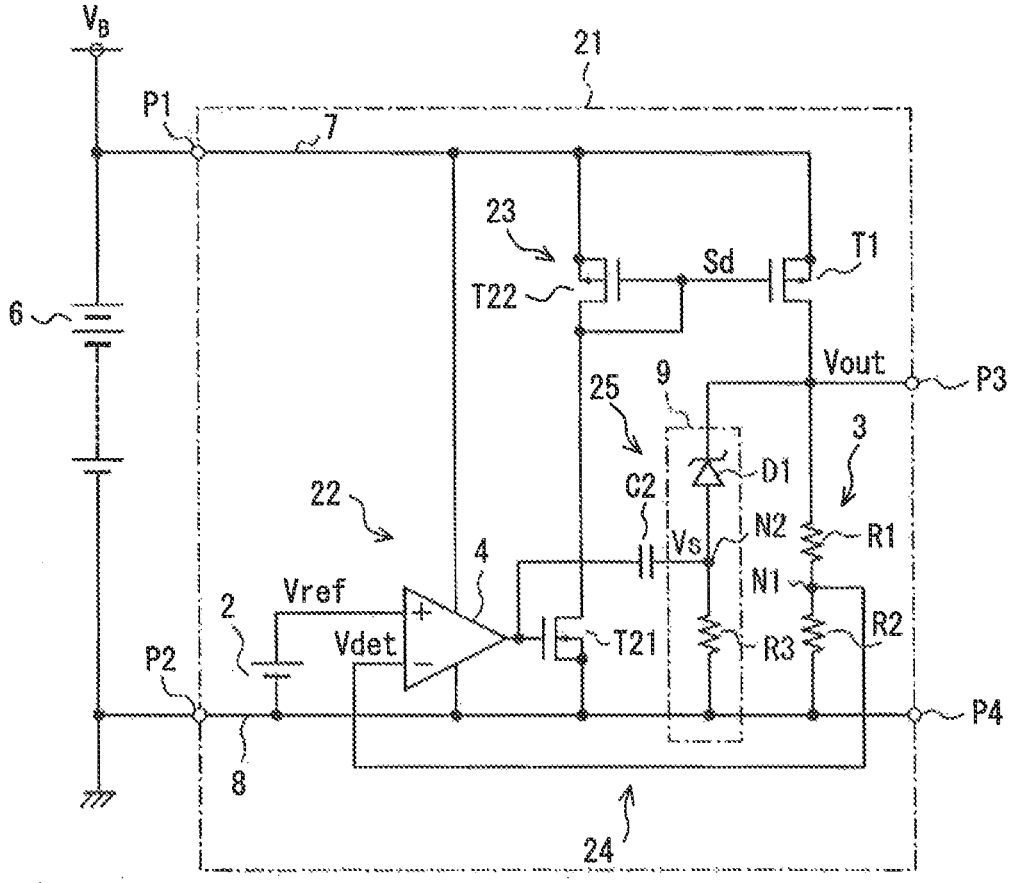
FIG. 3 is a schematic circuit diagram of a series regulator power supply circuit according to a second embodiment of the present disclosure.

FIG. 3 is a schematic circuit diagram of the power supply circuit 21 of the second embodiment. In FIG. 3, the parasitic capacitance C3 accompanying the phase compensation capacitor C2 and the smoothing capacitor C1 disposed outside of the power supply circuit 21 are not illustrated.

The power supply circuit 21 includes an error amplifier 22 that is similar to the error amplifier 4 shown in FIG. 1, In FIG. 3, an amplifier circuit 23 that constitutes an output stage of the error amplifier 22 is illustrated in detail. The amplifier circuit 23 performs an amplifying operation relative to the potential (ground potential) of the ground line 8 as a reference potential. The amplifier circuit 23 includes a transistor T21 and a transistor T22. For example, the transistor T21 is an N-channel MOSFET, and the transistor T22 is a P-channel MOSFET.

A gate of the transistor T21 is applied with a signal outputted from an amplifier circuit (not shown) disposed at an earlier stage of the error amplifier 22. A source of the transistor T21 is coupled to the ground line 8. A drain of the transistor 121 is coupled to the power supply line 7 through the transistor T22. A drain of the transistor T22 is coupled to the drain of the main transistor T1. A source of the transistor T22 is coupled to the power supply line 7. A gate of the transistor 122 is coupled to the gate of the main transistor T1. The gate of the transistor T22 and the drain of the transistor T22 are coupled in common. In this structure, the gate of the transistor T22 serves as an output terminal of the error amplifier 22 to output the error amplifier signal Sd.

The phase compensation circuit 24 includes a phase compensation section 25 and the level shift circuit 9. In the phase compensation section 25, the coupling position of the phase compensation capacitor C2 is different from that of the phase compensation section 10 shown in FIG. 1. In particular, the phase compensation capacitor C2 of the phase compensation section 25 is coupled between the node N2 that corresponds to the output terminal of the level shift circuit 9 and the gate of the transistor T21 that constitutes the amplifier circuit 23 of the error amplifier 22. In other words, the phase compensation capacitor C2 is disposed on a route between the node N2 and the input terminal of the amplifier circuit 23.

Also in the phase compensation circuit 24 in which the phase compensation capacitor C2 is coupled at a different position from that of the first embodiment, the phase compensation of the power supply circuit 21 is performed, and the stability of the power supply circuit 21 improves.

The voltage corresponding to the difference between the shift voltage Vs and the voltage of the input terminal of the amplifier circuit 23 is applied between the terminals of the phase compensation capacitor C2. That is, the voltage applied between the terminals of the phase compensation capacitor C2 is lower than the voltage applied between the terminals of the capacitor of the conventional phase compensation circuit by the predetermined voltage shifted by the level shift circuit 9. Therefore, also in the structure of the present embodiment, the advantageous effects similar to the first embodiment will be achieved.

The terminal of the phase compensation capacitor C2 adjacent to the amplifier circuit 23 is applied with the voltage in a range between the ground terminal (0 V) and a gate-source voltage of the transistor T21. That is, the terminal of the phase compensation capacitor C2 adjacent to the amplifier circuit 23 is applied with the voltage approximate to the ground potential. In the present embodiment, the output voltage Vout is shifted toward the ground potential by the predetermined voltage, by the level shift circuit 9. Therefore, the voltage applied between the terminals of the phase compensation capacitor C2 is properly reduced. Further, the phase compensation section 25 feeds back the ac component of the output voltage Vout, which is outputted relative to the ground potential as the reference potential, to the input terminal of the amplifier circuit 23. Accordingly, in the present embodiment, the effect of the phase compensation is sufficiently achieved.

Third Embodiment

A third embodiment of the present disclosure will be described with reference to FIG. 4. A power supply circuit 31 of the third embodiment has a main transistor 131 that is different from the main transistor T1 of the first embodiment. Hereinafter, a point different from the first embodiment will be mainly described.

Figure 4:
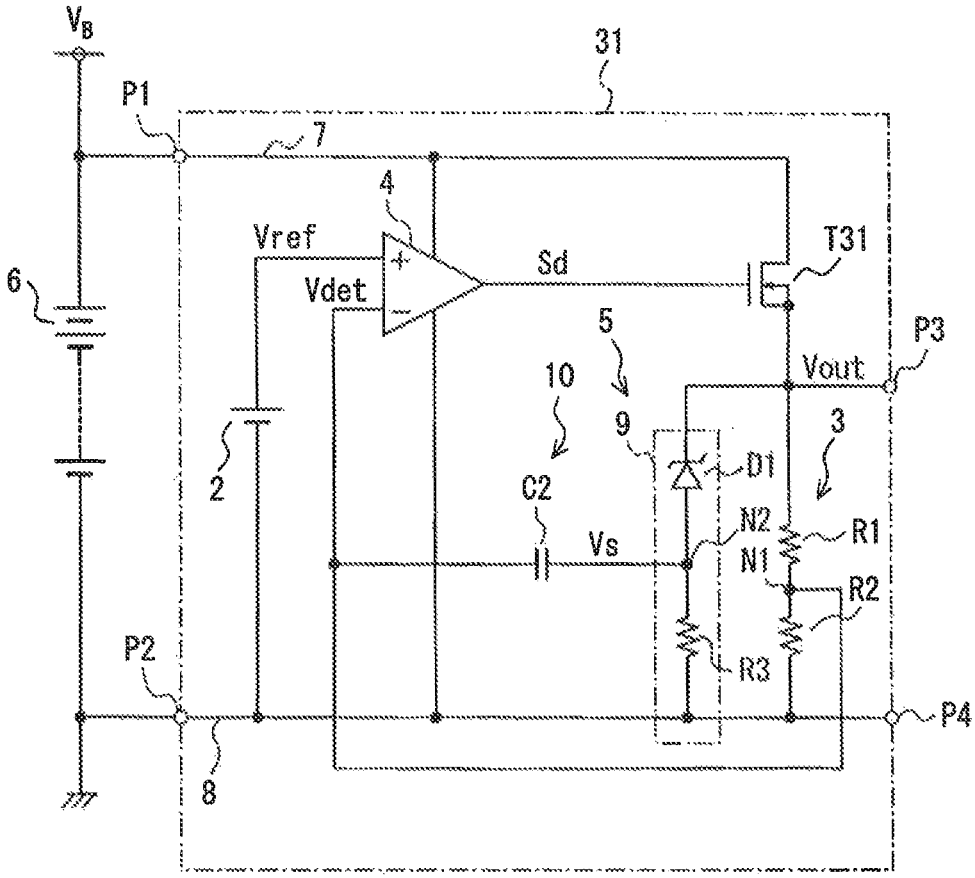
FIG. 4 is a schematic circuit diagram of a series regulator power supply circuit according to a third embodiment of the present disclosure.

In FIG. 4, the parasitic capacitance C3 accompanying the phase compensation capacitor C2 and the smoothing capacitor C1 disposed outside of the power supply circuit 31 are not illustrated.

As shown in FIG. 4, the power supply circuit 31 is an NMOS output-type series regulator power supply circuit. That is, the main transistor T31 is an N-channel power MOSFET. A drain of the main transistor T31 is coupled to the power supply line 7. A source of the main transistor T31 is coupled to the power supply output terminal P3.

The non-inverting input terminal of the error amplifier 4 is applied with the reference voltage Vref. The inverting input terminal of the error amplifier 4 is applied with the detection voltage Vdet. The phase compensation capacitor C2 is disposed between the node N2 and the inverting input terminal of the error amplifier 4.

Also in the NMOS output-type series regulator power supply circuit 31, the advantageous effects similar to the first embodiment will be achieved. In this way, the phase compensation circuit of the present disclosure is applied to the NMOS output-type series regulator power supply circuit.

Fourth Embodiment

Figure 5:
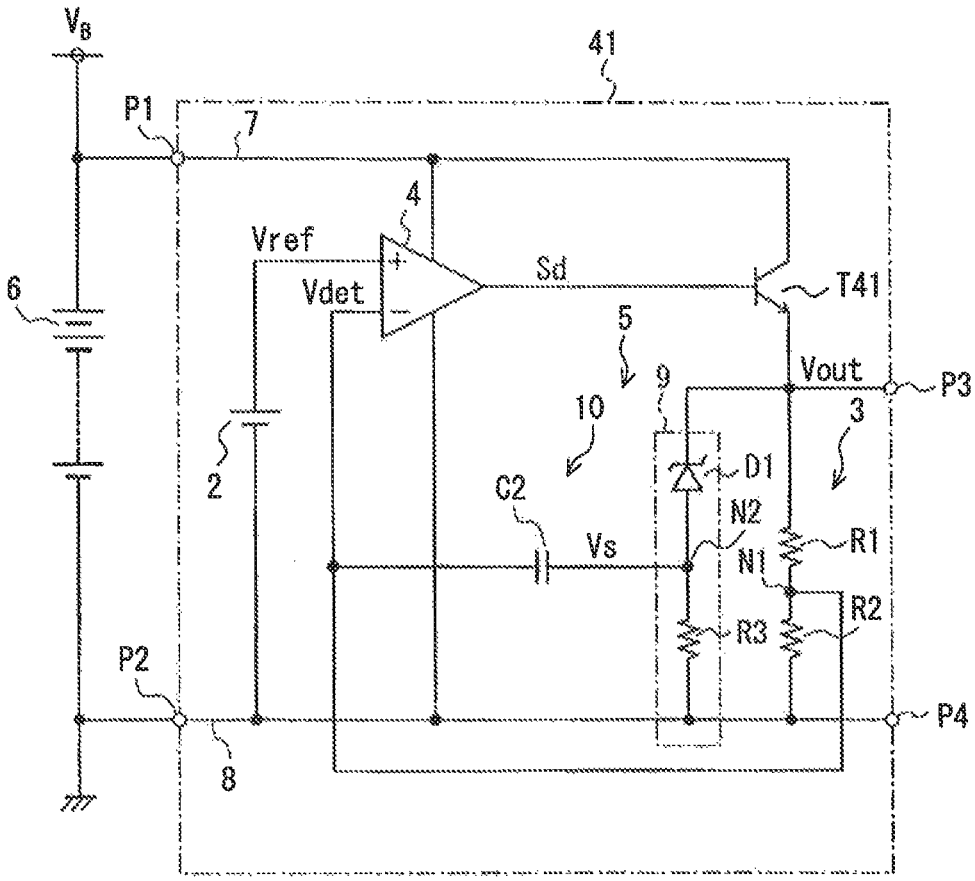
FIG. 5 is a schematic circuit diagram of a series regulator power supply circuit according to a fourth embodiment of the present disclosure.

A fourth embodiment of the present disclosure will be described with reference to FIG. 5. A power supply circuit 41 of the fourth embodiment has a main transistor T41 that is different from the main transistor T1 of the first embodiment. Hereinafter, a point different from the first embodiment will be mainly described. In FIG. 5, the parasitic capacitance C3 accompanying the phase compensation capacitor C2 and the smoothing capacitor C1 disposed outside of the power supply circuit 41 are not illustrated.

As shown in FIG. 5, the power supply circuit 41 is an NPN output-type series regulator power supply circuit. That is, the main transistor T41 is an NPN-type bipolar transistor. A collector of the main transistor T41 is coupled to the power supply line 7. An emitter of the main transistor is coupled to the power supply output terminal P3. A base of the main transistor T41 is applied with the error amplification signal Sd.

The non-inverting input terminal of the error amplifier 4 is applied with the reference voltage Vref. The inverting input terminal of the error amplifier 4 is applied with the detection voltage Vdet. The phase compensation capacitor C2 is disposed between the node N2 and the inverting input terminal of the error amplifier 4.

Also in the NPN output-type series regulator power supply circuit 41, the advantageous effects similar to the first embodiment will be achieved. In this way, the phase compensation circuit of the present disclosure is applied to the NPN output-type series regulator power supply circuit.

Fifth Embodiment

Figure 6:
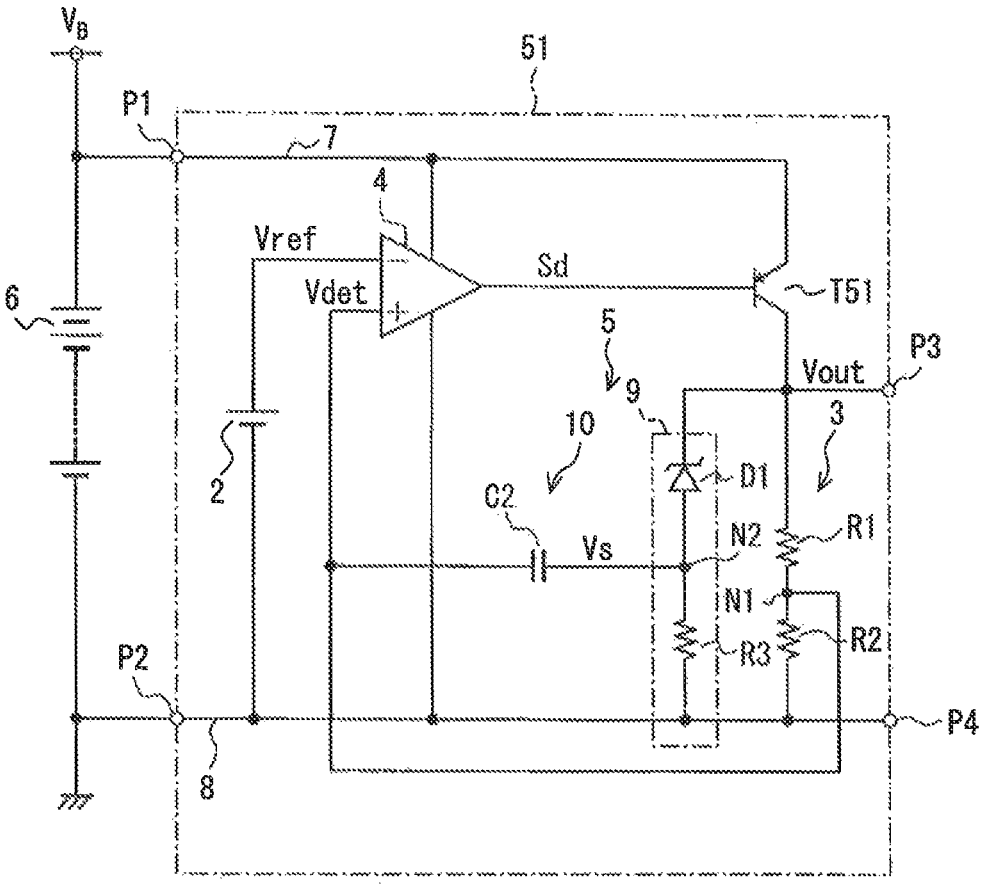
FIG. 6 is a schematic circuit diagram of a series regulator power supply circuit according to a fifth embodiment of the present disclosure.

A fifth embodiment of the present disclosure will be described with reference to FIG. 6. A power supply circuit 51 of the fifth embodiment has a main transistor T51 that is different from the main transistor T1 of the first embodiment. Therefore, points different from the first embodiment will be hereinafter mainly described. In FIG. 6, the parasitic capacitance C3 accompanying the phase compensation capacitor C2 and the smoothing capacitor C1 disposed outside of the power supply circuit 51 are not illustrated.

The power supply circuit 51 shown in FIG. 6 is a PNP output-type series regulator power supply circuit. That is, the main transistor T51 is a PNP-type bipolar transistor. An emitter of the main transistor T51 is coupled to the power supply line 7. A collector of the main transistor T51 is coupled to the power supply output terminal P3. A base of the main transistor T51 is applied with the error amplification signal Sd. The non-inverting input terminal of the error amplifier 4 is applied with the detection voltage Vdet. The inverting input terminal of the error amplifier 4 is applied with the reference voltage Vref. The capacitor C2 is disposed between the node N2 and the non-inverting input terminal of the error amplifier 4.

Also in the PNP output-type series regulator power supply circuit 51, the advantageous effects similar to the first embodiment will be achieved. In this way, the phase compensation circuit of the present disclosure is applied to the PNP output-type series regulator power supply circuit. Namely, as described in the third to fifth embodiments, the phase compensation circuit of the present disclosure is applied to any series regulator power supply circuit, irrespective of the type of the main transistor.

Sixth Embodiment

Figure 7:
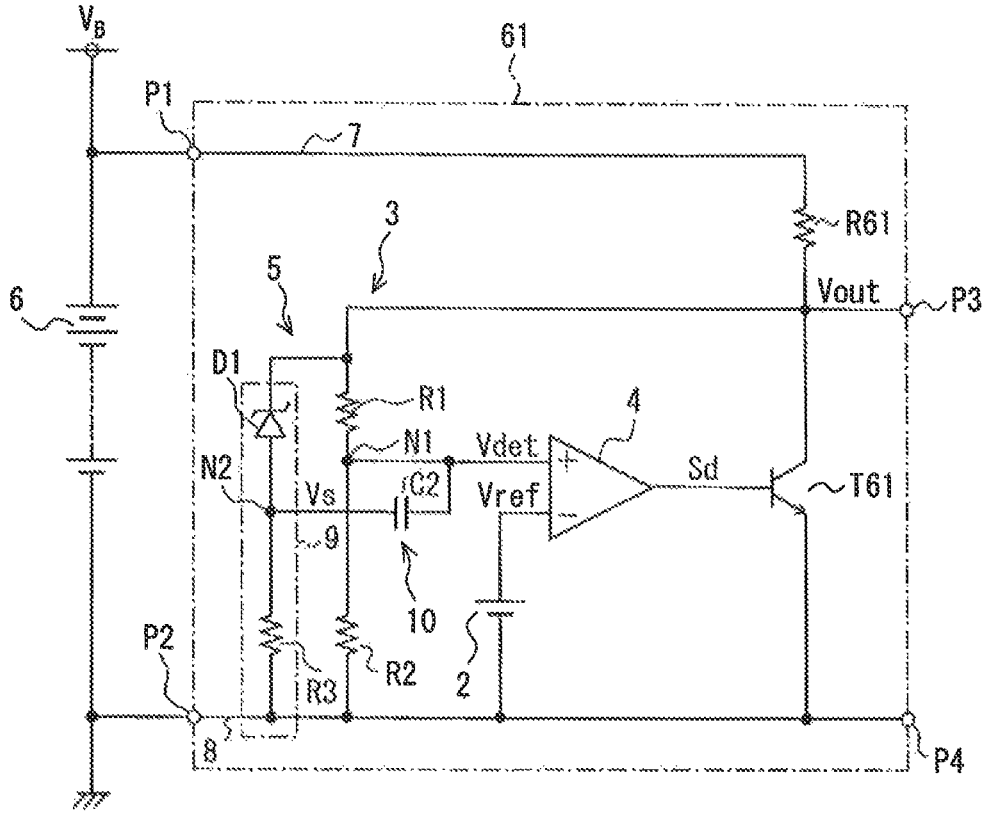
FIG. 7 is a schematic circuit diagram of a shunt regulator power supply circuit according to a sixth embodiment of the present disclosure.

A sixth embodiment will be described hereinafter with reference to FIG. 7. Hereinafter, a point different from the first embodiment will be mainly described. As shown in FIG. 7, a power supply circuit 61 of the sixth embodiment is a shunt regulator power supply circuit. The power supply circuit 61 includes a resistor R61, a main transistor T61, the reference voltage generation circuit 2, the voltage detection circuit 3, the error amplifier 4, and the phase compensation circuit 5.

The main transistor T61 is an NPN-type bipolar transistor. A collector of the main transistor T61 is coupled to the power source output terminal P3. An emitter of the main transistor T61 is coupled to the ground line 8. A base of the main transistor T61 is applied with the error amplification signal Sd. The resistor R61 is coupled between the power supply input terminal P1 and the power supply output terminal P3.

The reference voltage Vref outputted from the reference voltage generation circuit 2 is applied to the inverting input terminal of the error amplifier 4. The detection voltage Vdet outputted from the voltage detection circuit 3 is applied to the non-inverting input terminal of the error amplifier 4. The phase compensation capacitor C2 of the phase compensation circuit 5 is coupled between the node N2 and the non-inverting input terminal of the error amplifier 4. In FIG. 7, the parasitic capacitance C3 accompanying the phase compensation capacitor C2 is not illustrated.

The error amplifier 4 controls an operation of the main transistor T61 based on the detection voltage Vdet and the reference voltage Vref such that the output voltage Vout coincides with the target value. In particular, in a period where the detection voltage Vdet is higher than the reference voltage Vref, that is, in a period where the output voltage Vout is higher than the target value, the error amplifier 4 outputs the error amplification signal Sd at the high level. As a result, the main transistor T61 is turned on, and the output voltage Vout reduces.

In a period where the detection voltage Vdet is lower than the reference voltage Vref, that is, in a period where the output voltage Vout is lower than the target value, the error amplifier 4 outputs the error amplification signal Sd at the low level. As a result, the main transistor T61 is turned off, and the output voltage Vout increases. In this way, the error amplifier 4 controls the main transistor T61 to regulate the output voltage Vout to the target value.

Also in the shunt regulator power supply circuit 61, the advantageous effects similar to the first embodiment will be achieved. In the power supply circuit 61, the main transistor 61 is not limited to the NPN-type bipolar transistor, but may be any transistor, such as a power MOSFET, and a PNP-type bipolar transistor. That is, the phase compensation circuit of the present disclosure is applied to any linear regulator power supply circuits, such as the series regulator power supply circuit and the shunt regulator power supply circuit.

Seventh Embodiment

A seventh embodiment will be described with reference to FIG. 8. Hereinafter, a point different from the first embodiment will be mainly described.

Figure 8:
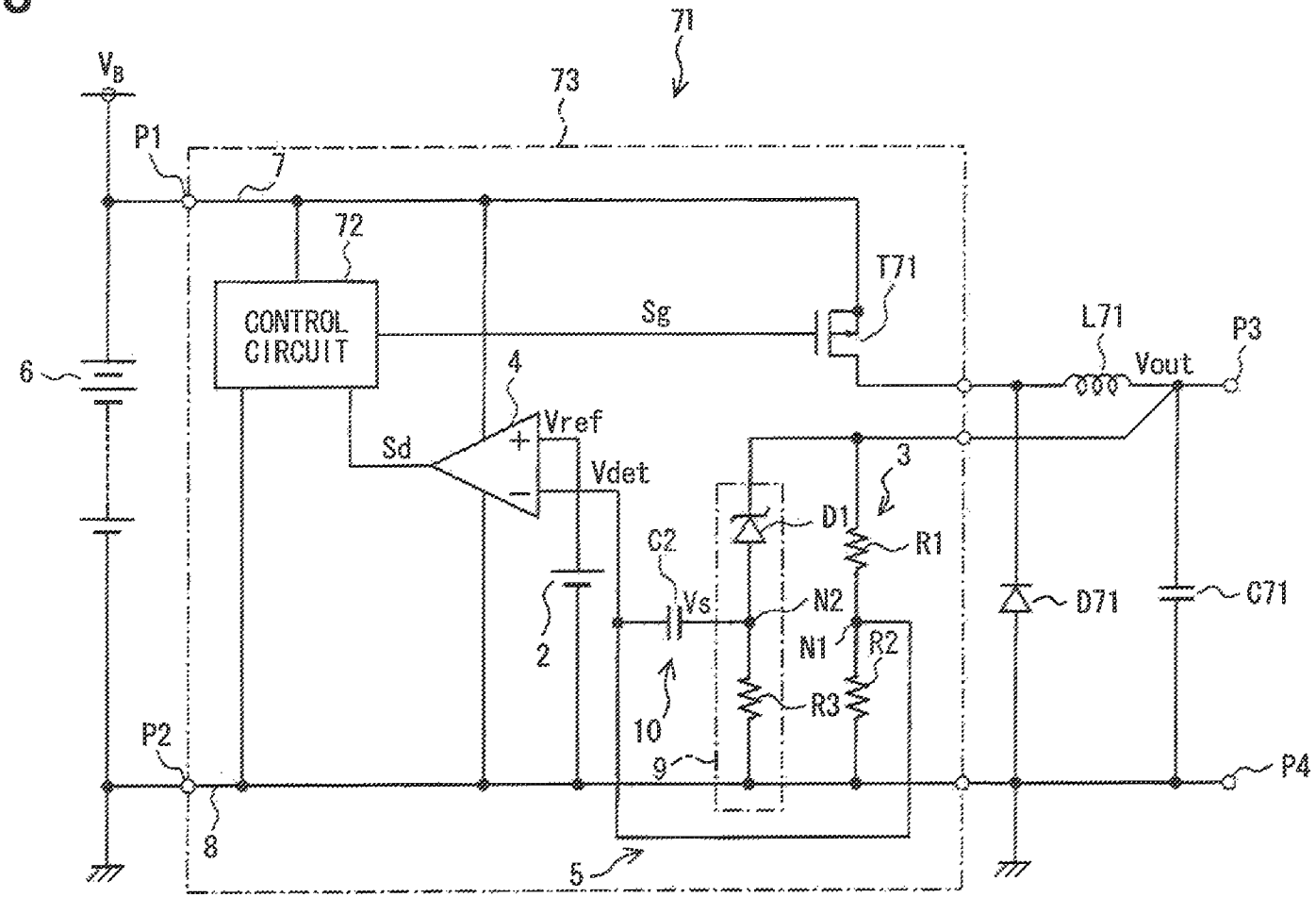
FIG. 8 is a schematic circuit diagram of a step-down switching regulator power supply circuit according to a seventh embodiment of the present disclosure.

As shown in FIG. 8, a power supply circuit 71 of the seventh embodiment is a step-down switching regulator power supply circuit. The power supply circuit 71 includes a main transistor T71, the reference voltage generation circuit 2, the voltage detection circuit 3, the error amplifier 4, a control circuit 72, a free-wheeling diode D71, an inductor L71, a smoothing capacitor C71, and the phase compensation circuit 5. The component elements of the power supply circuit 71 other than the diode D71, the inductor L71 and the capacitor C71 are integrated into a semiconductor integrated circuit 73.

The main transistor T71 is a P-channel power MOSFET A source of the main transistor T71 is coupled to the power supply line 7. A drain of the main transistor T71 is coupled to the power supply output terminal P3 through the inductor L71. A gate of the main transistor T71 is applied with a gate drive signal Sg outputted from the control circuit 72. The diode D71 is coupled between the drain of the main transistor T71 and the ground line 8 in such a manner that an anode of the diode D71 is coupled to the ground line 8. The capacitor C71 is coupled between the power supply output terminal P3 and the ground terminal P4.

The reference voltage Vref outputted from the reference voltage generation circuit 2 is applied to the non-inverting input terminal of the error amplifier 4. The detection voltage Vdet outputted from the voltage detection circuit 3 is applied to the inverting input terminal of the error amplifier 4. The phase compensation capacitor C2 of the phase compensation circuit 5 is coupled between the node N2 and the inverting input terminal of the error amplifier 4. In FIG. 8, the parasitic capacitance C3 accompanying the phase compensation capacitor C2 is not illustrated.

The error amplifier 4 outputs the error amplification signal Sd according to the difference between the detection voltage Vdet and the reference voltage Vref to the control circuit 72. The control circuit 72 controls an operation of the main transistor T71 based on the error amplification signal Sd such that the output voltage Vout coincides with the target value. In particular, the control circuit 72 performs feedback control such that the output voltage Vout has the constant value (target value) by varying a duty ratio or a frequency of the gate drive signal Sg based on the error amplification signal Sd.

Also in the step-down switching regulator power supply circuit 71 described above, the advantageous effects similar to the first embodiment will be achieved. In the power supply circuit 71, the main transistor T71 is not limited to the P-channel power MOSFET, but may be any transistor such as an N-channel power MOSFET and a bipolar transistor. That is, the phase compensation circuit of the present disclosure is applied to any step-down switching regulator power supply circuits.

Eighth Embodiment

An eighth embodiment of the present disclosure will be hereinafter described with reference to FIG. 9. Hereinafter, a point different from the first embodiment will be mainly described.

Figure 9:
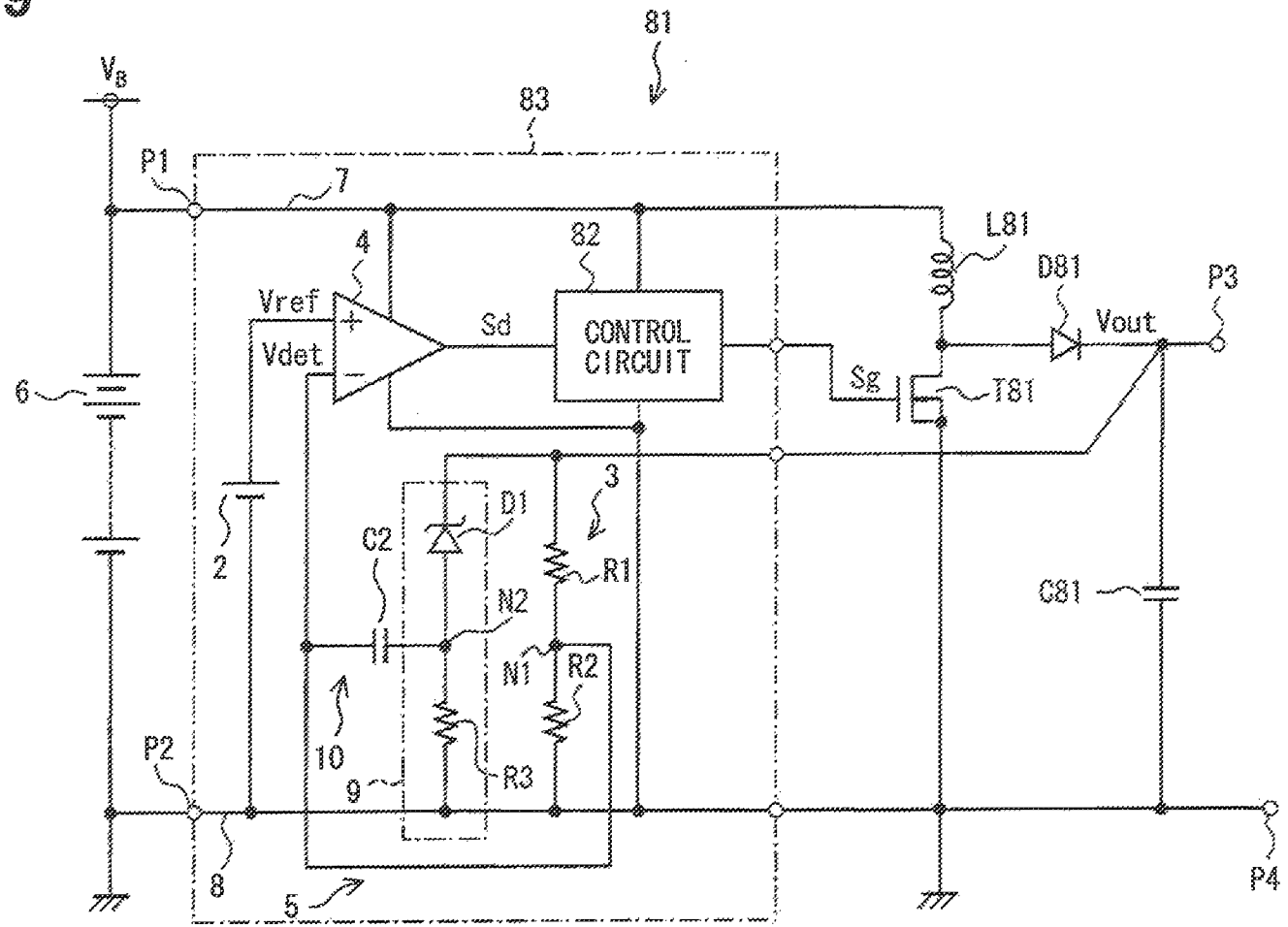
FIG. 9 is a schematic circuit diagram of a step-up switching regulator power supply circuit according to an eighth embodiment of the present disclosure.

As shown in FIG. 9, a power supply circuit 81 of the eighth embodiment is a step-up (boosting) switching regulator power supply circuit. The power supply circuit 81 includes a main transistor T81, the reference voltage generation circuit 2, the voltage detection circuit 3, the error amplifier 4, a control circuit 82, a free-wheeling diode D81, an inductor L81, a smoothing capacitor C81, and the phase compensation circuit 5. The component elements of the power supply circuit 81 other than the main transistor T81, the diode D81, the inductor L81 and the capacitor C81 are integrated into a semiconductor integrated circuit 83.

The main transistor T81 is an N-channel power MOSFET. A drain of the main transistor T81 is coupled to the power supply line 7 through the inductor L81. A source of the main transistor T81 is coupled to the ground line 8. A gate of the main transistor T81 is applied with the gate drive signal Sg outputted from the control circuit 82. The diode D81 is coupled between the drain of the main transistor T81 and the power supply output terminal P3 in such a manner that the anode of the diode D81 is coupled to the drain of the main transistor T81. The capacitor C81 is coupled between the power supply output terminal P3 and the ground terminal P4.

The reference voltage Vref outputted from the reference voltage generation circuit 2 is applied to the non-inverting input terminal of the error amplifier 4. The detection voltage Vdet outputted from the voltage detection circuit 3 is applied to the inverting input terminal of the error amplifier 4. The phase compensation capacitor C2 of the phase compensation circuit 5 is coupled between the node N2 of the shift level circuit 9 and the inverting input terminal of the error amplifier 4. In FIG. 9, the parasitic capacitance accompanying the phase compensation capacitor C2 is not illustrated.

The error amplifier 4 outputs the error amplification signal Sd according to the difference between the detection voltage Vdet and the reference voltage Vref to the control circuit 82. The control circuit 82 controls the main transistor T81 based on the error amplification signal Sd such that the output voltage Vout coincides with the target value. Specifically, the control circuit 82 performs the feedback control such that the output voltage Vout has the constant value (target value) by varying the duty ratio or the frequency of the gate drive signal Sg based on the error amplification signal Sd.

Also in the step-up switching regulator power supply circuit 81, the advantageous effects similar to the first embodiment will be achieved. In the power supply circuit 81, the main transistor T81 is not limited to the N-channel power MOSFET, but may be any transistor such as an NPN bipolar transistor. That is, the phase compensation circuit of the present disclosure may be applied to any step-up switching regulator power supply circuits.

Other Embodiment

The present disclosure is not limited to the embodiments described hereinabove with reference to the drawings, but may be modified or expanded in the following manners.

The level shift circuit 9 may have any structure as long as it receives the output voltage Vout and generates the shift voltage Vs by shifting the dc component of the output voltage Vout toward the ground potential by the predetermined voltage. For example, the level shift circuit 9 may be configured as shown in FIGS. 10A-10F.

Figure 10A:
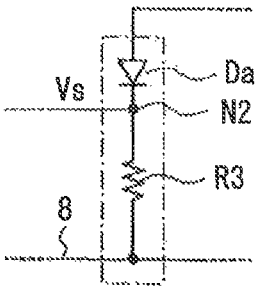
FIGS. 10A through 10F are schematic circuit diagrams of modifications of a level shift circuit of the phase compensation circuit.

The level shift circuit shown in FIG. 10A includes a diode as and a resistor R3. An anode of the diode Da is coupled to the power supply output terminal P3, and a cathode of the diode Da is coupled to the ground line 8 through the resistor R3. That is, the diode Da is disposed between the power supply output terminal P3 and the round line 8 in a forward direction. In this structure, the shift voltage Vs is outputted from the node N2 (i.e., the cathode of the diode Da), which is defined by the connecting point between the diode Da and the resistor R3. In the level shift circuit of FIG. 10A, the predetermined voltage shifted is equal to a forward voltage of the diode Da.

Figure 10B:
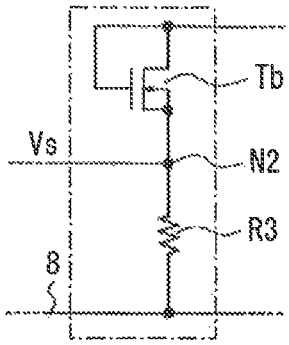
Figure 10C:
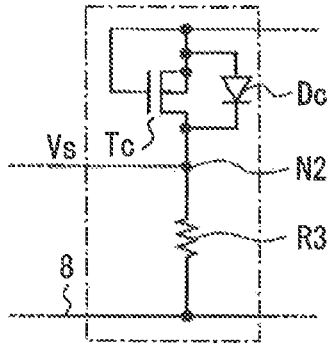
Figure 10D:
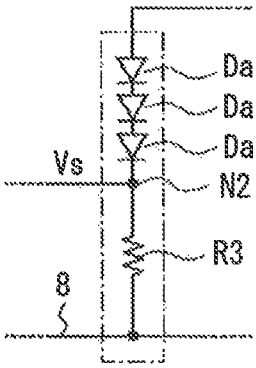

The level shift circuit of FIG. 10A may be modified into a structure shown in FIG. 10D. In the example of FIG. 10D, three diodes as are coupled in series. That is, the level shift circuit may have two or mode diodes Da coupled in series. In such a case, the predetermined voltage is equal to a voltage that is obtained by a multiplication of the forward voltage VF by the number of diodes Da used.

The level shift circuit shown in FIG. 102 includes a transistor Tb and the resistor R3. The transistor Tb is an N-channel MOSFET. The transistor Tb is saturation-connected such that the drain and the gate are coupled to each other. The drain of the transistor Tb is coupled to the power supply output terminal P3, and the source of the transistor Tb is coupled to the ground line 8 through the resistor R3. In this structure, the shift voltage Vs is outputted from the node N2 defined by the connecting point of the source of the transistor Tb and the resistor R3. In the shift level circuit of FIG. 10B, the predetermined voltage shifted is equal to a threshold voltage of the transistor Tb.

Figure 10E:
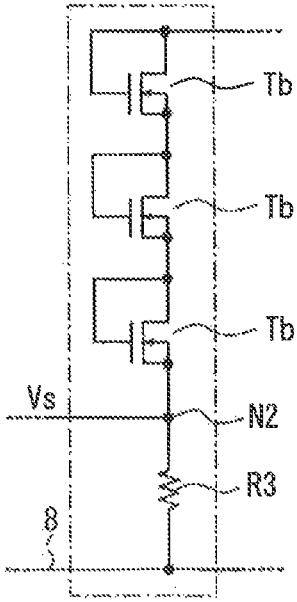

The level shift circuit of FIG. 10B may be modified into a structure shown in FIG. 10E. In the example shown in FIG. 10E, three transistors Tb each saturation-connected are coupled in series. That is, the level shift circuit of FIG. 10B may have two or more transistors Tb coupled in series. In this case, the predetermined voltage shifted is equal to a voltage obtained by a multiplication of the threshold voltage by the number of transistors Tb used. The transistor Tb may be a P-channel MOSFET or a bipolar transistor.

The level shift circuit shown in FIG. 10C includes a transistor To and a resistor R3. The transistor Tc is an N-channel MOSFET. The transistor Tc is provided with a parasitic diode Dc. The source and the gate of the transistor To are coupled to each other. The source of the transistor Tc is coupled to the power supply output terminal P3, and a drain of the transistor Tc is coupled to the ground line 8 through the resistor R3. In this structure, the shift voltage Vs is outputted from the node N2, which is defined by the connecting point between the drain of the transistor Tc and the resistor R3. In the level shift circuit of FIG. 10C, the predetermined voltage is equal to a forward voltage VF of the parasitic diode Dc.

Figure 10F:
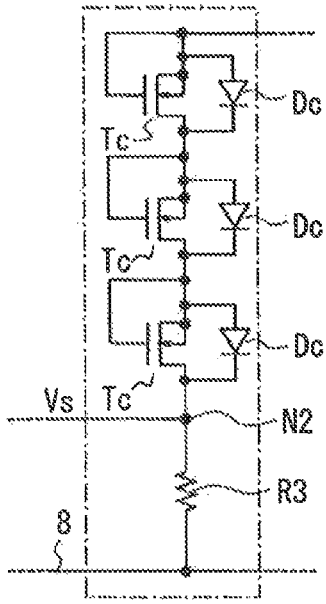

The level shift circuit of FIG. 10C may be modified into a structure shown in FIG. 10F. In the example shown in FIG. 10F, three transistors To are coupled in series. In this way, the level shift circuit of FIG. 10C may have two or more transistors Tc coupled in series. In this case, the predetermined voltage shifted is equal to a voltage obtained by a multiplication of the forward voltage VF by the number of transistors To used. The transistor To may be a P-channel MOSFET.

In the level shift circuit 9, the Zener diode D1 is disposed at least between the power supply output terminal P3 and the ground line 8 in a reverse direction. Therefore, a resistor element may be coupled in series to the Zener diode D1 at a position between the cathode of the Zener diode D1 and the power supply output terminal P3 or a position between the anode of the Zener diode D1 and the node N2. In such a case, the predetermined voltage shifted by the level shift circuit 9 is equal to a voltage that is obtained by adding the voltage drop at the resistor element to the Zener voltage of the Zener diode D1.

In the level shift circuit shown in FIG. 10A, the diode Da is disposed at least between the power supply output terminal P3 and the ground line 8 in a forward direction. Therefore, a resistor element may be coupled in series to the diode Da at a position between the anode of the diode Da and the power supply output terminal P3 or a position between the cathode of the diode Da and the node N2. In such a case, the predetermined voltage shifted by the level shift circuit is equal to a voltage obtained by adding the voltage drop at the resistor element to the forward voltage VF of the diode Da. Also in the level shift circuits shown in FIGS. 10B and 10C, the similar modification as described in connection with the level shift circuit of FIG. 10A may be applied.

The phase compensation section 10 has at least one capacitor (capacitive element). That is, the phase compensation section 10 may have plural capacitors coupled in series, or plural capacitors coupled in parallel. Further, the phase compensation section 10 may have a series circuit of at least one capacitor and at least one resistive element. Furthermore, the phase compensation section 10 may be configured by combining these structures in any ways.

The coupling position of the phase compensation capacitor C2 is not limited to the position described in the embodiments. That is, the phase compensation capacitor C2 is disposed at least on a route between the node N2, which corresponds to the output terminal of the level shift circuit 9, and the input terminal of the amplifier circuit of the error amplifier 4. The error amplifier 4 includes at least one amplifier circuit. For example, the phase compensation capacitor C2 may be disposed at both the position of FIG. 1 and the position of FIG. 3. That is, one phase compensation capacitor C2 may be disposed at the position between the node N2 and the non-inverting input terminal of the error amplifier 4 and another phase compensation capacitor C2 may be disposed at the position between the node N2 and the input terminal of the amplifier circuit 23.

Figure 11:
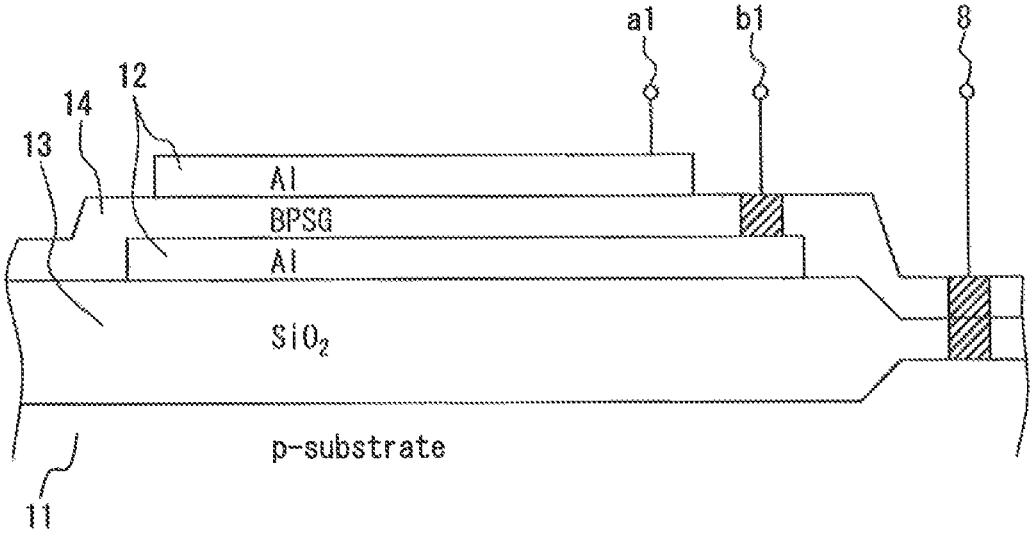
FIG. 11 is a schematic diagram of a phase compensation capacitor of a phase compensation circuit according to another embodiment.

In a case where the phase compensation circuit is configured as the semiconductor integrated circuit, the phase compensation capacitor C2 may be provided by a capacitance formed between a wiring pattern (e.g., poly-Si) and a wiring pattern (e.g., poly-Si). FIG. 11 illustrates an example of the phase compensation circuit configured as the semiconductor integrated circuit. As shown in FIG. 11, the phase compensation capacitor C2 may be provided by a capacitance formed between a wiring pattern (e.g., Al) 12 and a wiring pattern (e.g., Al) 12. In FIG. 11, numeral 14 denotes a boron phosphorous silicate glass (BPSG) film. In this case, an electrode of one of the two wiring patterns 12 may be coupled to the input terminal of the amplification circuit of the error amplifier. The parasitic capacitance C3 as shown in FIG. 1 does not exist in any of the electrodes of the phase compensation capacitor C2. In such a structure, therefore, the effect of phase compensation by the phase compensation capacitor C2 is favorably achieved.

In the embodiments described above, the power supply circuit including the phase compensation circuit of the present disclosure is exemplarily integrated into the semiconductor integrated circuit. However, the phase compensation circuit may be constructed of discrete components. Further, the power supply circuit including the phase compensation circuit may be constructed of discrete components. Also in such structures, the phase compensation of the power supply circuit, which has the relatively high target value of the output voltage Vout, may be achieved without largely increasing the circuit area and the consumption current.

While only the selected exemplary embodiments have been chosen to illustrate the present disclosure, it will be apparent to those skilled in the art from this disclosure that various changes and modifications can be made therein without departing from the scope of the disclosure as defined in the appended claims. Furthermore, the foregoing description of the exemplary embodiments according to the present disclosure is provided for illustration only, and not for the purpose of limiting the disclosure as defined by the appended claims and their equivalents.

What is claimed is:

1. A phase compensation circuit for a power supply circuit, the power supply circuit generating a constant output voltage from an input voltage inputted to the power supply circuit through a power supply input terminal, and outputting the output voltage from a power supply output terminal, the power supply circuit including a main transistor and an error amplifier, the main transistor controlling power supply from the power supply input terminal to the power supply output terminal, the error amplifier controlling an operation of the main transistor based on a detection voltage according to the output voltage and a reference voltage according to a target value of the output voltage such that the output voltage coincides with the target value, the error amplifier including at least one amplifier circuit, the phase compensation circuit comprising:

a level shift circuit configured to receive the output voltage and shift a dc component of the output voltage toward a ground potential by a predetermined voltage to generate a shift voltage; and a phase compensation capacitor disposed on a route between an output terminal of the level shift circuit and an input terminal of the amplifier circuit of the error amplifier, wherein the level shift circuit includes a Zener diode and a resistor, the Zener diode is disposed in a reverse direction between the power supply output terminal of the power supply circuit and a ground line of the power supply circuit having the ground potential, the resistor is disposed between an anode of the Zener diode and the ground line, and the output terminal of the level shift circuit from which the shift voltage is outputted is defined at the anode of the Zener diode.

2. The phase compensation circuit according to claim 1, wherein the phase compensation capacitor is disposed on the route between the output terminal of the level shift circuit and the input terminal of the amplifier circuit that performs an amplification operation relative to the ground potential as a reference.

3. The phase compensation circuit according to claim 1, wherein the power supply circuit is a switching regulator.

4. The phase compensation circuit according to claim 1, wherein the power supply circuit is a linear regulator.

5. A phase compensation circuit for a power supply circuit, the power supply circuit generating a constant output voltage from an input voltage inputted to the power supply circuit through a power supply input terminal, and outputting the output voltage from a power supply output terminal, the power supply circuit including a main transistor and an error amplifier, the main transistor controlling power supply from the power supply input terminal to the power supply output terminal, the error amplifier controlling an operation of the main transistor based on a detection voltage according to the output voltage and a reference voltage according to a target value of the output voltage such that the output voltage coincides with the target value, the error amplifier including at least one amplifier circuit, the phase compensation circuit comprising:

a level shift circuit configured to receive the output voltage and shift a dc component of the output voltage toward a ground potential by a predetermined voltage to generate a shift voltage; and a phase compensation capacitor disposed on a route between an output terminal of the level shift circuit and an input terminal of the amplifier circuit of the error amplifier, wherein the level shift circuit includes a diode and a resistor, the diode is disposed in a forward direction between the power supply output terminal of the power supply circuit and a ground line of the power supply circuit having the ground potential, the resistor is disposed between a cathode of the diode and the ground line, and the output terminal of the level shift circuit from which the shift voltage is outputted is defined at the cathode of the diode.

6. A semiconductor integrated circuit comprising the phase compensation circuit according to claim 1, wherein the phase compensation capacitor is provided by one of a capacitor defined between a wiring pattern and a semiconductor substrate and a capacitor defined between wiring patterns, and an electrode of the phase compensation capacitor coupled to the wiring pattern is coupled to the input terminal of the amplifier circuit.

7. A power supply circuit for generating a constant output voltage from an input voltage inputted to the power supply circuit through a power supply input terminal and outputting the output voltage from a power supply output terminal, the power supply circuit comprising:

a main transistor controlling power supply from the power supply input terminal to the power supply output terminal;

an error amplifier controlling an operation of the main transistor based on a detection voltage according to the output voltage and a reference voltage corresponding to a target value of the output voltage such that the output voltage coincides with the target value, the error amplifier including at least one amplifier circuit; and a phase compensation circuit including a level shift circuit and a phase compensation capacitor, wherein the level shift circuit is configured to receive the output voltage and shift down a dc component of the output voltage by a predetermined voltage to generate a shift voltage, wherein the level shift circuit includes a Zener diode and a resistor, the Zener diode is disposed in a reverse direction between the power supply output terminal of the power supply circuit and a ground line of the power supply circuit having the ground potential, the resistor is disposed between an anode of the Zener diode and the ground line, and the output terminal of the level shift circuit from which the shift voltage is outputted is defined at the anode of the Zener diode, and the phase compensation capacitor is disposed on a route between an output terminal of the level shift circuit and an input terminal of the amplifier circuit of the error amplifier.

* * * * *